United States Patent [19]

Mosher

[11] Patent Number: 4,846,039

[45] Date of Patent: Jul. 11, 1989

[54] NECK FOR STRINGED MUSICAL INSTRUMENTS

[75] Inventor: Stephen B. Mosher, Eugene, Oreg.

[73] Assignee: Moses, Inc., Eugene, Oreg.

[21] Appl. No.: 165,239

[22] Filed: Mar. 7, 1988

[51] Int. Cl.[4] ..... G10D 1/08

[52] U.S. Cl. ..... 84/293; 84/452 P

[58] Field of Search ..... 84/267, 293, 452 R, 84/452 P

[56] References Cited

U.S. PATENT DOCUMENTS 4,145,948 3/1979 Turner ..... 84/293

4,192,213 3/1980 Steinberger ..... 84/293

*Primary Examiner*—Lawrence R. Franklin

*Attorney, Agent, or Firm*—John F. Ingman

[57] ABSTRACT

A neck for stringed musical instruments which is solid in form and constructed of alternating layers of an epoxy resin and powdered carbon mixture, and of longitudinally laid carbon fibers, preferably in the form of carbon fiber ribbon, which have been coated with the epoxy resin and powdered carbon mixture, with any remaining space within the form also filled with the epoxy resin and powdered carbon mixture. The preferred epoxy resin and powdered carbon mixture is thirty percent powdered carbon, by volume. A method for construction includes a three-piece form within whose cavities the alternating layers of carbon fiber ribbon and epoxy resin and powdered carbon mixture are laid.

4 Claims, 2 Drawing Sheets

NECK FOR STRINGED MUSICAL INSTRUMENTS

BACKGROUND OF THE INVENTION

1. Field of the Invention

The present invention generally relates to necks for stringed musical instruments, and, more particularly, to a solid neck comprised of carbon fibers, powdered carbon and epoxy resin which results in an instrument of moderate weight with improved stability and tonal qualities.

2. Description of the Prior Art

The necks of stringed instruments made of wood tend to warp and bend due to changes in temperature and humidity combined with the stresses placed upon the neck by the strings themselves. Prior art improvements in neck construction have included the addition of metal truss rods to stiffen the neck. Other prior art has incorporated laminated neck structures, more elaborate truss structures, and the casting of necks of metal, such as aluminum.

U.S. Pat. No. 4,084,476 discloses a neck for stringed musical instruments wherein an elongated reinforcing member, or members, made of a material having a high modulus of elasticity, form part of the body of the neck. A preferred material for this reinforcing member or members was a composite material consisting of graphite filaments embodied in a resin matrix. U.S. Pat. No. 4,145,948 goes beyond the use of graphite fiber reinforced plastic material as an included reinforcing member, and discloses a neck, consisting of a lower laminate structure of channel-shaped cross-section which is closed by a neck plate to form a hollow neck structure. The lower neck closed channel structure is fabricated in one piece, utilizing graphite fibers preimpregnated and embodied in polymeric resin matrix material, such as epoxy, with the grpahite fibers oriented longitudinally in the direction of the neck. An upper neck plate is bonded to the lower neck structure, and a separate fingerboard is bonded to the upper surface of the upper neck plate. A manner of manufacture of the graphite composite material is disclosed as being molded under pressure at an elevated temperature, the cured components then being machined by conventional techniques and adhesively bonded together to produce the hollow neck beam structure.

The prior art in necks for stringed instruments utilizing carbon fibers and epoxy resin material has utilized a hollow segmented structure, which structure tends to have problems of warpage and delamination. Hollow segmented necks also may have discontinuities, such as gaps and air spaces along lines of lamination, which reduce the transmission of sound through the neck and which may produce tonal distortions.

What is needed is an improved neck of moderate weight for stringed instruments which minimizes discontinuities within the neck structure to allow maximum transmission of sound along and through the neck. The neck should be structurally stable to provide appropriate strength and stiffness without warpage and delamination.

SUMMARY OF THE INVENTION

The present invention provides an improved neck for stringed instruments designed to satisfy the aforementioned needs. The invention involves a solid neck comprised of epoxy resin mixed with powdered carbon, and carbon fibers.

Accordingly, the invention comprises a stringed instrument neck which is solid in form, and of single piece construction, including an integrated fingerboard surface. The solid neck, in the preferred embodiment, is constructed of alternating layers of an epoxy resin and powdered carbon mixture, and of longitudinally laid carbon fiber ribbon which has been coated with the epoxy resin and powdered carbon mixture, with any remaining space within the form of the neck also filled with epoxy resin mixed with powdered carbon. Carbon fibers, in the form of carbon fiber ribbon, have been treated with epoxy resin to produce greater likeness to the epoxy resin and powdered carbon mixture, while bonding carbon fiber to carbon fiber. The result is a stringed musical instrument neck of integrated mass, providing a medium for the cohesive and consistent transfer of soundwaves. The combination of carbon and epoxy resin in all portions of the solid neck approaches a homogeneity of materials in the one-piece, solid neck, thereby allowing for maximum sound wave movement not only along the length of the neck, but also circumferentially around the neck. Eliminated are disassociated masses, dead spots, and voids within the neck which allow sound waves to be attenuated and distorted as they attempt to cross lines of discontinuity of material in the neck.

A method of creating the neck involves the use of a three-piece form in which the alternating layers of carbon fiber ribbon and epoxy resin and powdered carbon mixture are laid.

DESCRIPTION OF THE PREFERRED EMBODIMENT

Figure 1:
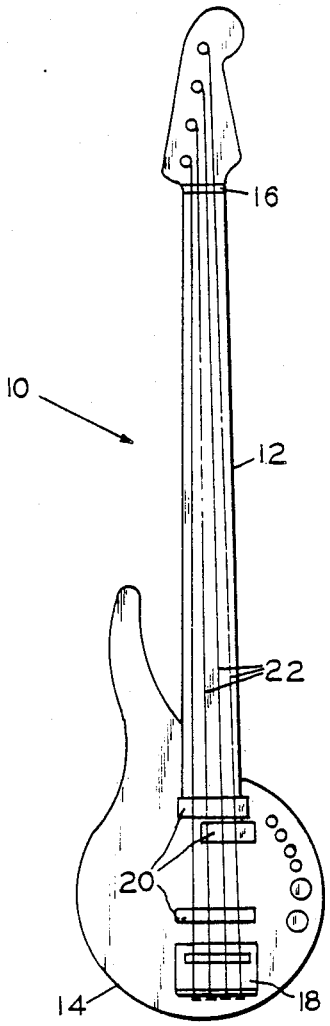
FIG. 1 illustrates a top plan view of an electric bass guitar with the improved neck for stringed instruments.

Referring to the various drawings, there is shown in FIG. 1 a stringed musical instrument, in the form of an electric bass guitar 10, which includes the preferred embodiment of the improved neck 12. The guitar 10, in addition to the neck 12, has a body section 14. The preferred neck 12 for the electric bass guitar 10 is bolted onto the body section 14 so as to provide continuity for the transmission of sound waves in the neck 12 from the nut 16 to the bridge 18. Alternatively, the neck 12 may extend through the length of the body 14 (not shown).

Figure 2:
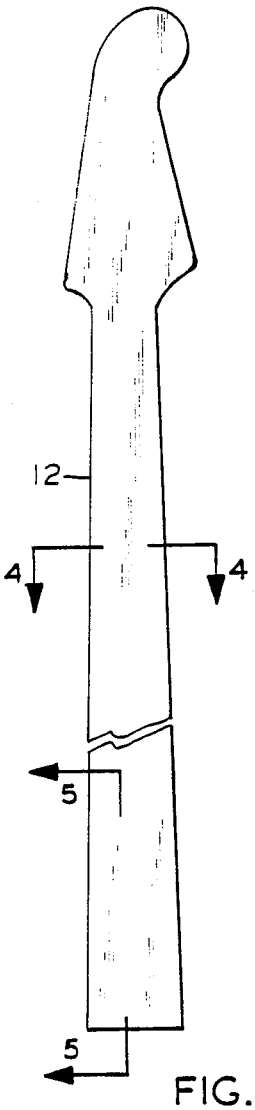
FIG. 2 illustrates a plan view of the improved neck for stringed musical instruments.
Figure 3:
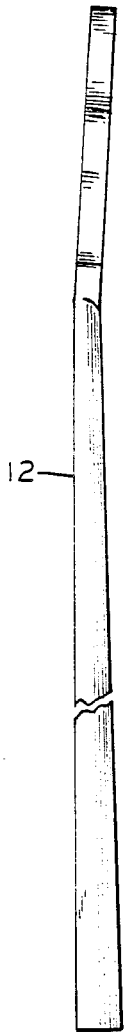
FIG. 3 illustrates a side view of the improved neck for stringed instruments.

In the preferred electric bass guitar 10, electronic pickups 20 are located within the body 14 below each string 22 so as to pick up vibrations therefrom. The electronic pickups 20 also receive vibrations transmitted along the neck 12, the amplitude and tonal qualities of neck-transmitted sound contributing to the sound ultimately produced by the instrument. FIG. 2 and FIG. 3 illustrate plan and side views of the neck 12, as applied to the electric bass guitar 10 of FIG. 1, or a similar instrument. While illustrated in conjunction with an electric bass guitar 10, the invention has general applicability to all stringed instruments, both acoustic and electric.

Figure 5:
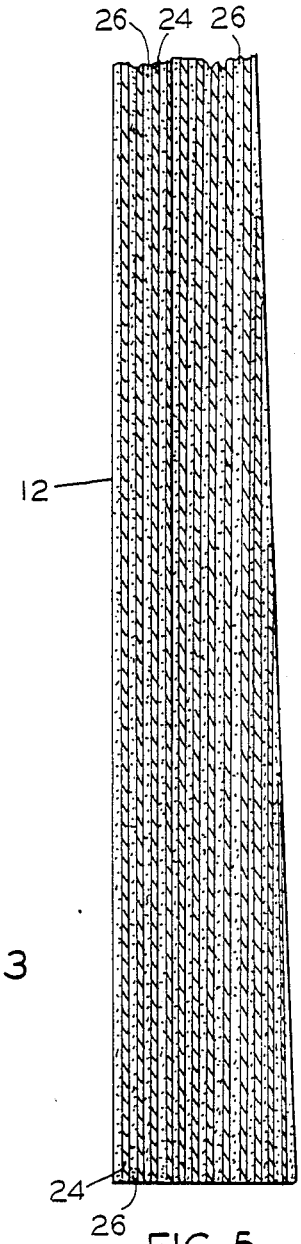
FIG. 5 illustrates a longitudinal cross section of the improved neck as seen at 5—5 of FIG. 2.
Figure 4:
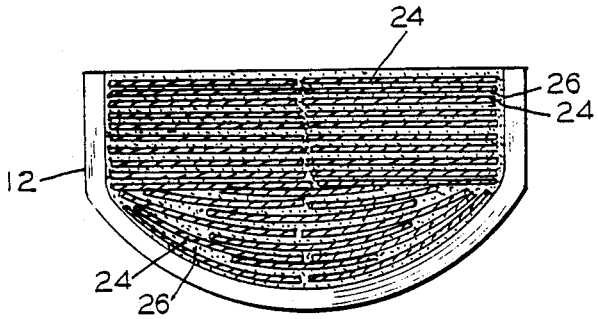
FIG. 4 illustrates a transverse cross section of the improved neck as seen at 4—4 of FIG. 2.

Explicit to the instant invention are the materials and construction of the neck 12. As shown schematically in FIG. 4 and FIG. 5, the neck 12 is formed of alternating layers of carbon fibers, in the preferred form of carbon fiber ribbon 24, and a mixture 26 of epoxy resin and powdered carbon, the carbon fiber ribbon 24 having been coated with the epoxy resin and powdered carbon mixture 26. Any voids are filled into solid form with the epoxy resin and powdered carbon mixture 26. Such filling occurs before the epoxy resin is cured to minimize oxidation and maximize internal bonding of all materials. The carbon fiber ribbon 24 has been treated with epoxy resin to produce greater likeness to the epoxy resin and powdered carbon mixture 26. Similarly, the epoxy resin has been mixed with powdered carbon to create greater likeness to the epoxy resin coated carbon fibers. The powdered carbon addition to the epoxy resin ties together the mass and produces a material having superior hardness, strength, stiffness, and sound wave transfer characteristics. Additionally, the extensive use of carbon in the neck 12 produces a high carbon to epoxy resin ratio which lessens the weight of the neck. The filling in, between the layers of carbon fiber ribbon 24 and in any voids, within a solid neck configuration, with the epoxy resin and powdered carbon mixture 26 results in an instrument neck 12 of moderate weight with an integrated structure, and produces a medium for cohesive and consistent transfer of sound waves through the instrument. The resulting combination of carbon, in either fiber ribbon or powder form, and epoxy resin in all portions of the solid neck results in substantial homogeneity in the one-piece solid neck, thereby allowing for maximum sound wave movement not only from one end of the neck 12 to the other, but also circumferentially around the neck 12. The improved neck 12 has thereby eliminated disassociated masses and voids within the neck, which, in the prior art, allow soundwaves to be attenuated and distorted as they attempt to cross discontinuities in the neck materials, It should be noted that FIG. 4 and FIG. 5 are merely schematic in nature, the layers of coated carbon fiber ribbon 24 essentially filling the neck 12 with the layers of epoxy resin and powdered carbon mixture 26 being very thin and serving as a bonding agent between the layers of carbon fiber ribbon 24.

The preferred epoxy resin is Gougen Brothers 105, which is made for and has proved excellent in laying up carbon fiber ribbon, has low toxicity and has a preferred working temperature of 70 degrees Farenheit. One-inch wide carbon ribbon provides a practical and efficient form of carbon for the instant application. A preferred carbon ribbon is Gougen Brothers 701. A total of over 97-feet of one-inch carbon fiber ribbon is commonly used in construction of a typical neck 12 for an electric bass guitar 10. A preferred powdered carbon is graphite powder marketed as Gougen Brothers 423. The preferred epoxy resin and powdered carbon mixture 26 is approximately thirty percent powdered carbon, by volume, which represents the maximum amount of powdered carbon which will remain suspended in the epoxy resin.

Figure 6:
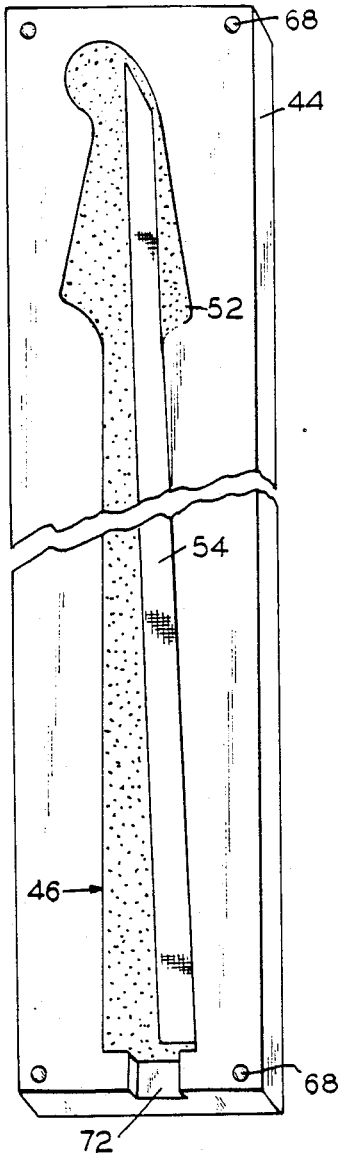
FIG. 6 illustrates a form member for laying the top and upper sides of the improved neck.
Figure 7:
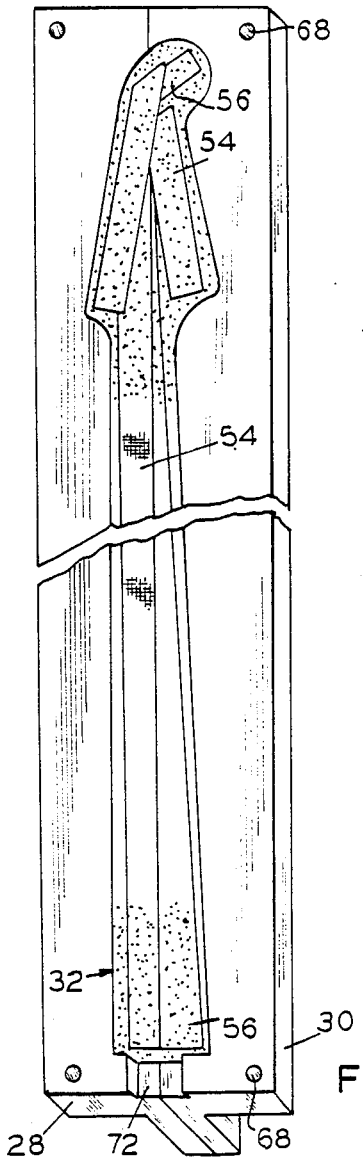
FIG. 7 illustrates two form members joined together for laying the bottom and lower sides of the improved neck.
Figure 9:
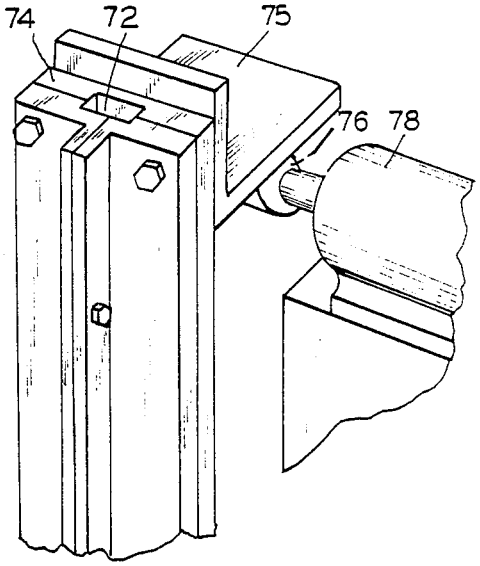
FIG. 9 illustrates a manner of vibrating the complete form of FIG. 8 during the manufacture of the improved neck.
Figure 8:
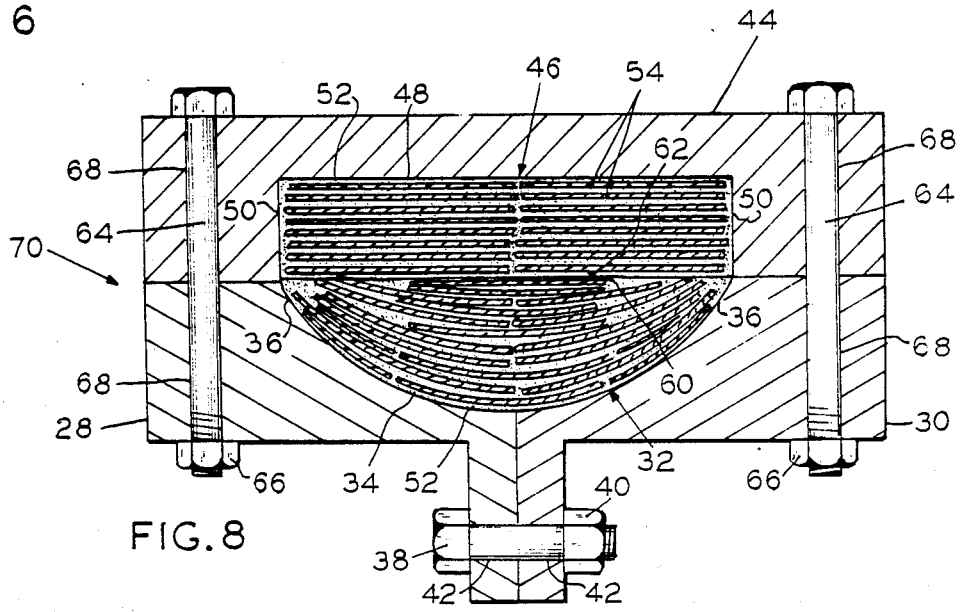
FIG. 8 illustrates a cross section of the form member of FIG. 6 and the joined form members of FIG. 7 combined together into a complete form.

A method of construction of the improved neck for stringed musical instruments involves a three-piece form as shown in FIG. 6 through FIG. 9. The method comprises the following steps:

1. A first form member 28 and a second form member 30 are joined together so as to provide a cavity 32 in the shape of the bottom 34 and lower sides 36 of the neck 12. This is best seen in FIG. 7 and FIG. 8. The manner of joining the first form member 28 and the second form member 30 may be by bolts 38 and nuts 40 through apertures 42 in the forms 28 and 30, or by other means. A third form member 44, shown at FIG. 6 and FIG. 8, which provides a cavity 46 in the shape of the top 48 and upper sides 50 of the neck 12, remains separate at this time.

2. An initial, thin layer 52 of epoxy resin and powdered carbon mixture 26 is applied, as by spraying or painting with a brush, on the surfaces of the cavities 32 and 46.

3. A layer of strips 54 of the carbon fiber ribbon 24 is laid, longitudinally to neck 12, on the initial layer 52 of epoxy resin and powdered carbon mixture 26. FIG. 6 illustrates, within cavity 46, the initial layer 52 of epoxy resin and powdered carbon mixture 26, and a single strip 54 of carbon fiber ribbon 24 laid thereon.

4. A thin coating or layer of epoxy resin and powdered carbon mixture 26 is then applied, as by a brush, to the surface of the strips 54 of carbon fiber ribbon 24 laid in Step 3 so as to coat the carbon fiber ribbon 24 with that mixture 26. FIG. 7 illustrates a number of strips 54 of carbon fiber ribbon 24 laid and partially covered by the mixture 26 at 56.

5. An additional layer of carbon fiber ribbon 24 is laid on the most previously applied layer of epoxy resin and powdered carbon mixture 26, the additional layer 24 also being generally oriented longitudinally within the cavity 32, 46.

6. An iterative process of the Steps 4 and 5 is continued with alternating layers of carbon fiber ribbon 24 and epoxy resin and powdered carbon mixture 26 being applied within the cavities 32 and 46. This iterative process terminates when, if the third form member 44 were joined to the previously joined first form member 28 and second form member 30, as best seen in FIG. 8, the last laid thin layer 62 of epoxy resin and powdered carbon mixture 26 in the third form member 44 would touch the last laid thin layer 60 of epoxy resin and powdered carbon mixture 26 in the joined first form member 28 and second form member 30.

7. The third form member 44 is joined with the previously joined first form member 28 and second form member 30, as with bolts 64 and nuts 66 through apertures 68, so as to produce a enclosed complete form 70, as seen in cross section in FIG. 8.

8. The complete form 70 is oriented vertically, and through a sprue or aperture 72 formed in the end 74 thereof, an additional quantity of epoxy resin and powdered carbon mixture 26 is introduced, as by pouring or injecting, so as to fill any voids between the layers of carbon fiber ribbon 24 and also any voids occurring at the joinder of the third form member 44 with the previously joined first and second form members 28 and 30. It has been found advantageous, concurrent with this addition of the mixture 26, to gently vibrate the vertical complete form 70 so as to dislodge trapped air within the complete form 70 and expedite its exit through the aperture 72. Such vibration can be achieved through pressing a form extension 75, attached to the total form 70, against an offset wheel 76 on an electric motor 78. A frequency vibration of 120 cycles per minute has been found to be effective.

9. The epoxy resin, as applied within the complete form 70, including the form members 28, 30 and 44, is allowed to cure until hardened.

10. Finally, the form members 28, 30 and 44 are separated from each other, exposing the hardened improved neck for stringed instruments; it being preferred to remove the first form member 28 and second form member 30 from each other after their combined removal from the third form member 44.

It is thought that the improved neck for stringed musical instruments, and the method of construction thereof, of the present invention and its many attendant advantages will be understood from the foregoing description and that it will be apparent that various changes may be made in form, construction and arrangement of the parts or steps thereof without departing from the spirit and scope of the invention or sacrificing all of its material advantages, the forms and method hereinbefore stated being merely exemplary embodiments thereof.

I claim:

1. A neck for stringed musical instruments, comprising a solid neck formed of a mixture of epoxy resin and powdered carbon, and of longitudinally laid carbon fibers.

2. The neck for stringed musical instruments, as recited in claim 1, wherein the solid neck is comprised of alternate layers of carbon fiber, in the form of carbon fiber ribbon, and the mixture of epxoy resin and powdered carbon.

3. The neck for stringed musical instruments, as recited in claim 1, wherein the mixture of epoxy resin and powdered carbon is, by volume, substantially thirty percent powdered carbon.

4. The neck for stringed musical instruments, as recited in claim 1, wherein the stringed musical instrument is an electric bass guitar.

* * * * *